US007470356B2

(12) United States Patent
You et al.

(10) Patent No.: US 7,470,356 B2
(45) Date of Patent: Dec. 30, 2008

(54) WIRELESS MONITORING OF TWO OR MORE ELECTROLYTIC CELLS USING ONE MONITORING DEVICE

(75) Inventors: Eugene Yanjun You, Salt Lake City, UT (US); Daniel Kang Kim, Salt Lake City, UT (US)

(73) Assignee: Kennecott Utah Copper Corporation, Magna, UT (US)

( * ) Notice: Subject to any disclaimer, the term of this patent is extended or adjusted under 35 U.S.C. 154(b) by 231 days.

(21) Appl. No.: 11/422,944

(22) Filed: Jun. 8, 2006

(65) Prior Publication Data

US 2006/0213766 A1 Sep. 28, 2006

Related U.S. Application Data

(63) Continuation-in-part of application No. 11/082,685, filed on Mar. 17, 2005, and a continuation-in-part of application No. 11/082,545, filed on Mar. 17, 2005.

(60) Provisional application No. 60/553,899, filed on Mar. 17, 2004.

(51) Int. Cl.
*C25C 1/12* (2006.01)

(52) U.S. Cl. ..... 205/574; 204/278.5; 204/242; 204/267; 204/269; 204/270

(58) Field of Classification Search ..... 204/278.5, 204/242, 267, 269, 270; 205/574
See application file for complete search history.

(56) References Cited

U.S. PATENT DOCUMENTS 3,793,166 A 2/1974 Shaw (Continued)

FOREIGN PATENT DOCUMENTS

EP 0597404 A2 5/1994

(Continued)

OTHER PUBLICATIONS

Marcy, Henry O., et al., Wireless Sensor Networks for Area Monitoring and Integrated Vehicle Health Management Applications, Rockwell Science Center, Thousand Oaks, CA, pp. 1-11, 1999*.

(Continued)

*Primary Examiner*—Bruce F Bell
(74) *Attorney, Agent, or Firm*—Whyte Hirschboeck Dudek SC

(57) ABSTRACT

A system, device, and method include a cell-powered first electronic device for monitoring two or more electrolytic cells is powered using electrical potential imposed across the electrolytic cells. The potential is voltage-boosted to accomplish this task. If the electrical potential imposed across the cells is insufficient, the device can also be battery-powered. In any event, this device is in communication with one or more sensors in the electrolytic cells, as well as a second electronic device, and the first and second electronic devices wirelessly communicate. More specifically, the first electronic device wireless transmits data signals to the second electronic device, which receives the same. The first and second electronic devices are physically remote from one another, and they communicate over a private or public network, preferably using spread spectrum technology. In addition, the second electronic device also preferably transmits data signals to a computer for further processing of the data signals, and these arrangements can be used, for example, when producing copper.

20 Claims, 14 Drawing Sheets

U.S. PATENT DOCUMENTS

| | | | | |
|---|---|---|---|---|
| 3,926,750 | A | 12/1975 | Adachi et al. | |
| 3,987,351 | A | 10/1976 | Appelberg et al. | |
| 4,035,251 | A | 7/1977 | Shiver et al. | |
| 4,038,162 | A | 7/1977 | Kapanen et al. | |
| 4,281,290 | A | 7/1981 | Peacey et al. | |
| 4,351,705 | A | 9/1982 | Ernst et al. | |
| 4,461,989 | A | 7/1984 | Dotson et al. | |
| 4,514,648 | A | 4/1985 | Dotson et al. | |
| 4,786,379 | A | 11/1988 | Barnett | |
| 5,250,903 | A | 10/1993 | Limuti et al. | |
| 5,404,329 | A | 4/1995 | Yamagata et al. | |
| 5,435,897 | A | 7/1995 | Zannini | |
| 5,526,253 | A | 6/1996 | Duley | |
| 5,592,115 | A | 1/1997 | Kassapian | |
| 5,636,115 | A | 6/1997 | Drouot | |
| 5,687,091 | A | 11/1997 | Maung et al. | |
| 5,768,115 | A | 6/1998 | Pascucci et al. | |
| 5,832,411 | A | 11/1998 | Schatzmann et al. | |
| 5,854,568 | A | 12/1998 | Moscaluk | |
| 5,880,628 | A | 3/1999 | Criscione et al. | |
| 5,999,107 | A | 12/1999 | Cooper et al. | |
| 6,136,177 | A | 10/2000 | Hung | |
| 6,140,820 | A | 10/2000 | James | |
| 6,231,641 | B1 | 5/2001 | Utigard et al. | |
| 6,278,318 | B1 | 8/2001 | Watanabe | |
| 6,281,684 | B1 | 8/2001 | James | |
| 6,356,137 | B1 | 3/2002 | Roohparvar et al. | |
| 6,503,648 | B1 | 1/2003 | Wang | |
| 6,507,237 | B2 | 1/2003 | Hsu et al. | |
| 6,592,736 | B2 | 7/2003 | Fulton et al. | |
| 6,833,205 | B2 | 12/2004 | Speranza et al. | |
| 2002/0160363 | A1 | 10/2002 | McDevitt et al. | |
| 2003/0066759 | A1 | 4/2003 | Hardee et al. | |
| 2003/0085179 | A1 | 5/2003 | Kim et al. | |
| 2003/0144581 | A1 | 7/2003 | Conn et al. | |
| 2003/0146744 | A1 | 8/2003 | Hauenstein et al. | |
| 2004/0211663 | A1 | 10/2004 | Gagne et al. | |
| 2005/0023151 | A1 | 2/2005 | Sandoval et al. | |
| 2006/0114642 | A1* | 6/2006 | Liu et al. | 361/500 |
| 2006/0115693 | A1* | 6/2006 | Toth et al. | 429/13 |
| 2006/0213766 | A1 | 9/2006 | You | |

FOREIGN PATENT DOCUMENTS

| | | | |
|---|---|---|---|
| GB | 2254416 | A1 | 11/2006 |

OTHER PUBLICATIONS

Chen, Steven et al., IEEE 1451 Smart Wireless Machinery Monitoring and Control for Naval Vessels, presented at the Thirteenth International Ship Control Systems Symposium (SCSS) in Orlando, Florida, Apr. 2003.

Maresca, Patrick, Linear Circuit Devices for Applications in Battery Powered Wireless Systems, Microchip Technology, Inc., pp. 1-8, 2003*.

Lee, Jr., Lloyd Dewey, Remote Machinery Condition Monitoring Using Wireless Technology and the Internet, MAARS Inc., reprinted from http://www.reliabilityweb.com**.

Tang, Yonghui et al., A 0.6V Ultra Low Voltage Operational Amplifier, Department of Electrical and Computer Engineering Iowa State University, Ames, IA.

Nippon Telegraph and Telephone Corporation and NTT Advanced Technology Corporation, Press Release, Launch of "Pocket Energy" in May 2004—A Prototype Versatile, Environmentally Friendly Solar-Powered Mobile Power Source for Portable Devices such as Mobile Phones, PDAs, and Digital Cameras—Feb. 13, 2004, http://www.ntt.co.jp/news/news04e/0402/040213.html.

Christlo, A., Computerized Cell Voltage Monitoring at the Electrolytic Refining and Smelting Company of Australia Limited, Port Kembia, NSW, Australia, Electrorefining and Winning of Copper: Proceedings of the Symposium, pp. 311-331, 1987.

Hoey, D.W., et al., Modern Tank House Design and Practices at Copper Refineries Pty. Ltd., Electrorefining and Winning of Copper: Proceedings of the Symposium, pp. 271-293, 1987.

O'Kane, John et al., Role of Computerised Cell Voltage Monitoring in Copper Electrolytic Refining at Copper Refineries Pty. Ltd., Townsville, Australia, Application of Polarization Measurements in the Control of Metal Deposition, pp. 270-284, 1984.

Biswas, et al., Extractive Metallurgy of Copper, 3rd Edition, 1994, pp. 324-357.

* cited by examiner

WIRELESS MONITORING OF TWO OR MORE ELECTROLYTIC CELLS USING ONE MONITORING DEVICE

CROSS-REFERENCE TO RELATED APPLICATIONS

This application is a continuation-in-part of U.S. Ser. Nos. 11/082,545 and 11/082,685 both filed on Mar. 17, 2005, and under 35 U.S.C. § 119(e) to Provisional Patent Application Ser. No. 60/553,899, filed on Mar. 17, 2004, the entire disclosures of which are hereby incorporated by reference.

BACKGROUND OF THE INVENTION

1. Field of the Invention

This invention relates to electrolytic cell monitoring for electrometallurgical systems, including, for example, i) electrorefining and electrowinning systems for copper, zinc, nickel, lead, cobalt, and other like metals, ii) electrochemical cells, such as chlor-alkali systems, and iii) molten salt electrolysis, such as aluminum and magnesium electrolysis.

Insofar as the inventive arrangements can be used with electrolytic cell monitoring during a copper refinement stage of producing copper, copper production is described for exemplary, representative, and non-limiting purposes.

2. Description of Related Art

Producing copper involves a series of steps involving mining, crushing and grinding, concentrating, smelting, converting, and refining procedures, each of which is well-known, shown in block diagram format in FIG. 1. As depicted, mining 10 loosens and collects ore. Crushing and grinding 12 turn the ore into a crushed and ground ore, comprising a fine powder in which desired ore minerals are liberated. Concentration 14 collects the desired ore minerals into a watery slurry, which is then filtered and dried to produce a liquid concentrate suitable for smelting. Smelting 16 smelts (i.e., melts and oxidizes) iron and sulfur in the liquid concentrate to produce a copper matte. Conversion 18 converts the copper matte by oxidation into a blister copper and finally, refinement 20 refines the blister copper into a finished product, i.e., cathode copper, typically with a copper purity of 99.99% or better.

The blister copper is refined, usually first pyrometallurgically and then electrolytically. More specifically, the blister copper is subjected to an additional purification step to further up-grade the copper content, such as fire refining in a reverberatory or rotary anode furnace. Then, the blister copper is cast into large, thick plates called anodes, which are often transferred from an anode casting plant to the electrolytic copper refinery by truck, rail, or the like.

In the electrolytic copper refinery, the anodes are lowered into an acidic solution that contains approximately 120-250 gpl of free sulfuric acid and approximately 30-50 gpl of dissolved copper. The anodes are also electrically connected to a positive direct current supply. To electrolyze the anodes in this aqueous electrolyte, they are separated by insoluble, interleaved stainless steel blanks called starter sheets or cathodes, which are negatively charged. Electricity is then sent between the anodes and cathodes for a pre-determined length of time, causing copper ions to migrate from the anodes to the cathodes to form plates at the cathodes, which contain less than 20 parts per million impurities (i.e., sulfur plus non-copper metals, but not including oxygen). Voltages of approximately 0.1-0.5 volts are generally sufficient to dissolve the anodes and deposit the copper on the cathodes, with corresponding current densities of approximately 160-380 amps/$m^2$. With each anode producing two cathode plates at which the refined copper is deposited, the cathode plates are then washed and ready for an ultimate end use.

In a typical copper refinery producing 300,000 tons of copper cathode per year, there can be as many as 1,440 electrolytic cells, each with 46 anodes and 45 cathode blanks, for a total of 131,000 pieces suspended into the cells. In such a traditional copper refinery, each cathode and each anode is electrically connected to the refinery current supply system through two or more contact points on the supporting ears of the anodes and the hanger bars of the cathodes. This means there can be a total of over 260,000 electrical connections (i.e., two per anode and two per cathode multiplied by the number of cathodes and anodes).

Critical to the efficient operation of the refining process is the absence of open and short circuits between the anodes and cathodes. As subsequently elaborated upon, short circuits can occur if the anodes and cathodes are mis-aligned or if copper deposits on the cathode grow in a non-uniform manner and contact the anode. When short circuits do occur, the desired copper plating process is disrupted. Open circuits, on the other hand, can occur if there is poor contact between the current supply and the anodes or cathodes. When open circuits do occur, the efficiency of electrical use decreases.

Thus, refinement 20 refines the blister copper into refined copper, which typically contains approximately 99.99 wt % copper (i.e., effectively, pure copper). Thereafter, refinement 20 allows the refined cathode copper to be converted into any number of copper end-products using conventional methods and techniques, which are well-known in the art.

The efficiency of copper refinement 20 can be increased by increasing the efficiency of cell monitoring. More specifically, at least two important cell parameters need to be closely monitored—namely, cell voltage and cell temperature. Failure to adequately monitor these two cell parameters, and others, can reduce metal recovery, increase scrap rate, and lead to inefficient energy utilization. Nevertheless, most electrolytic metal recovery and refining facilities do not effectively monitor these cell parameters, primarily due to high capital and operating costs associated with such cell monitoring. For example, these costs are significantly high when each individual electrolytic cell in a tank house is hardwired to parameter monitoring and transmission equipment. Doing so generally requires a significant amount of hardwiring in an environment that is inherently hostile, inherently corrosive, and inherently subject to large magnetic fields. In particular, while the voltage differential across any cell is on the order of 0.1 to 0.5 volts, the voltage differential across the entire tank house can be several hundred volts. It is inherently unsafe to simply connect wires to the individual cells and route these to voltage monitoring equipment because the voltage potential can be potentially fatal. Because presently existing cell monitoring equipment and technologies are expensive and require extensive hard wiring, both shortcomings have significantly deterred widespread market penetration of effective electrolytic cell monitoring.

As a result, open and short circuits commonly occur during the electrolytic refining of copper. They occur for many reasons, including i) poor anode and cathode physical qualities, ii) poor contact between the current supply and the anodes or cathodes, iii) misalignment of anodes and cathodes, and iv) localized variations in electrolyte temperature, additive levels, or chemistry. Thus, efficient electrolytic cell monitoring is important during the electrolytic refining of copper, as it can enable system operators to detect open and short circuits between anodes and cathodes, which, if not cleared, reduce current efficiencies and result in down-stream processing problems, such as poor cathode development. As known, copper impurity, copper content, and copper appearance are also ultimately adversely affected by open and short circuits.

Conventional monitoring focuses on only identifying short circuits between the anodes and cathodes. This is commonly accomplished by manually using a hand-held Gauss meter to detect abnormal magnetic fields flowing through the cathode. Such a procedure generally requires physically walking over the anodes and cathodes in each cell while closely observing the hand-held Gauss meter to detect a large deflection in a meter needle. Oftentimes, the Gauss meter is affixed to a distal end of a long stick or pole by which it can then be held close to the cathode hanger bar. Regardless, the task is both ergonomically difficult and accident-prone. Moreover, walking on the cells frequently misaligns the anode and cathodes, can lead to possible contamination, and often leads to further problems as well.

While detecting open and short circuits deals with their effects rather than their causes, it is a widely recognized technique for improving electrode quality. Accordingly, after a short circuit is detected, it is generally cleared by probing between the cathode and anode with a stainless steel rod to locate the fault and then physically separating (i.e., breaking off) an errant copper nodule growing at the epicenter of the short circuit. This often requires physically lifting the cathode out of the cell. Unfortunately, however, many open and short circuits are not often detected until after significant damage has already occurred.

Consequently, there is a need for less expensive, less intrusive, lower maintenance, and higher efficiency electrolytic cell monitoring systems and methods. Such systems and methods would increase energy utilization and efficiency during the copper refinement stage 20 of producing copper. Thus, a need exists for a cost effective, minimally intrusive, minimal maintenance, and increasingly efficient electrolytic cell monitoring systems and methods for measuring electrolytic cell parameters such as anode and cathode voltages and temperatures during the copper refinement stage 20 of producing copper.

SUMMARY OF THE INVENTION

In one embodiment, the inventive arrangements provide a system comprising a cell-powered first electronic device that is powered using electrical potential imposed across an electrolytic cell, in which the electrical potential is voltage-boosted to accomplish this task. If the electrical potential imposed across the cell is insufficient to power this device, it can also be battery-powered. In any event, this device is in communication with one or more sensors in the electrolytic cell, as well as a second electronic device, and the first and second electronic devices wirelessly communicate. More specifically, the second electronic device receives data signals from the first electronic device, the first electronic device transmitting the data signals thereto, the first and second electronic devices preferably being physically remote from one another and communicating over a private or public network, preferably using spread spectrum technology. In addition, the second electronic device also preferably transmits data signals to a computer for further processing of the data signals.

In another embodiment, the inventive arrangements provides a system comprising a single monitoring device for at least two electrolytic cells, the monitoring device powered using electrical potential imposed across the cells and in which the electrical potential can be voltage-boosted. If the electrical potential imposed across the cells is insufficient to power the device, then the device can be battery-powered. The device is in communication with one or more sensors located on or in each cell that it is monitoring as well as in wireless communication with an electrical device designed to receive electrical signals from the monitoring device.

In another embodiment, the inventive arrangements also provide an electrolytic cell monitoring device comprising an electronic component in communication with sensors in an electrolytic cell, the component being powered using electrical potential imposed across the cell, in which the potential is often voltage-boosted to accomplish this task. If the electrical potential imposed across the cell is insufficient to power this device, it can also be battery-powered.

In another embodiment, the inventive arrangements also provide a method for monitoring an electrolytic cell comprising providing a cell-powered first electronic device that is powered using electrical potential imposed across the cell, in which the method voltage-boosts the potential to accomplish this task. If the electrical potential imposed the cell is insufficient to power this device, the method can also power the device using a battery. In any event, this device is in communication with one or more sensors in the electrolytic cell, as well as a second electronic device, and the first and second electronic devices wirelessly communicate. More specifically, the method wirelessly transmits data signals from the first electronic device to the second electronic device, the first and second electronic devices preferably being physically remote from one another and communicating over a private or public network, preferably using spread spectrum technology.

In another embodiment, the inventive arrangements include the ECMs arranged in a personal area network (PAN) in which each ECM is in wireless electrical communication with a primary coordinator and at least one secondary or backup coordinator. The coordinators are in wireless electrical communication with at least one gateway which in turn is in electrical communication with a computer. The ECMs and coordinators are arranged in such a manner that if communication is lost between an ECM and its primary coordinator, then the ECM switches to its secondary or backup coordinator to re-establish ultimate communication with the system computer. If the communication is lost between the ECM and its primary and secondary coordinators, then the ECM will initiate a search for new coordinators. Thus the new primary and secondary PAN coordinators will be established according to their link cost or quality.

In another embodiment, the inventive arrangements also provide a method for producing high-purity copper comprising sampling sensors that monitor electrolytic cell parameters that correspond to physical properties of the cell to generate data signals, and then wirelessly transmitting the data signals to a remote electronic device.

BRIEF DESCRIPTION OF THE DRAWINGS

A clear conception of the advantages and features constituting inventive arrangements, and of various construction and operational aspects of typical mechanisms provided therewith, will become readily apparent by referring to the following exemplary, representative, and non-limiting illustrations, which form an integral part of this specification, wherein like reference numerals generally designate the same elements in the several views, and in which.

DETAILED DESCRIPTION OF PREFERRED EMBODIMENTS

Figure 1:
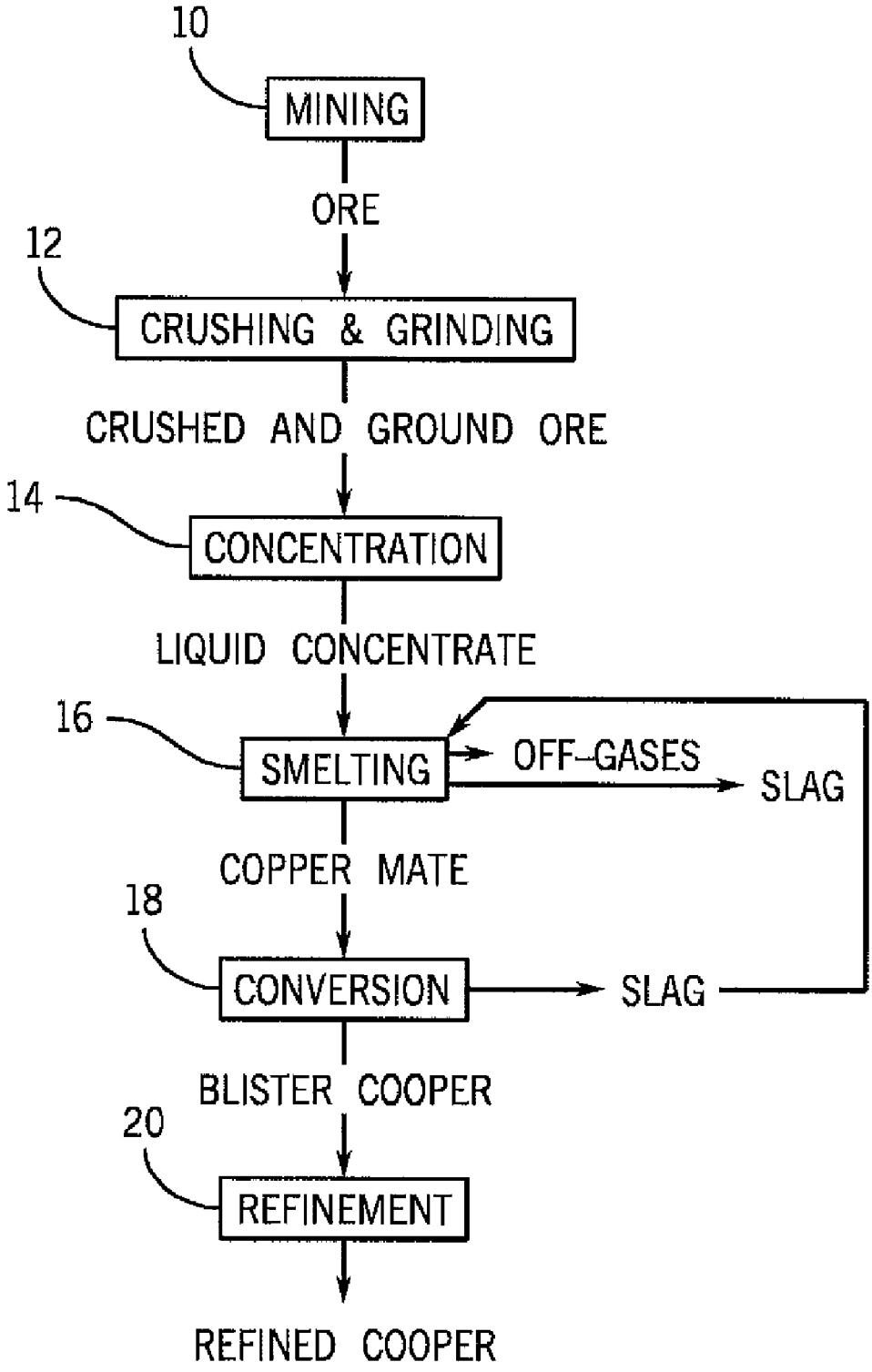
FIG. 1 is a prior art flow chart of electrometallurgical copper production.
Figure 2:
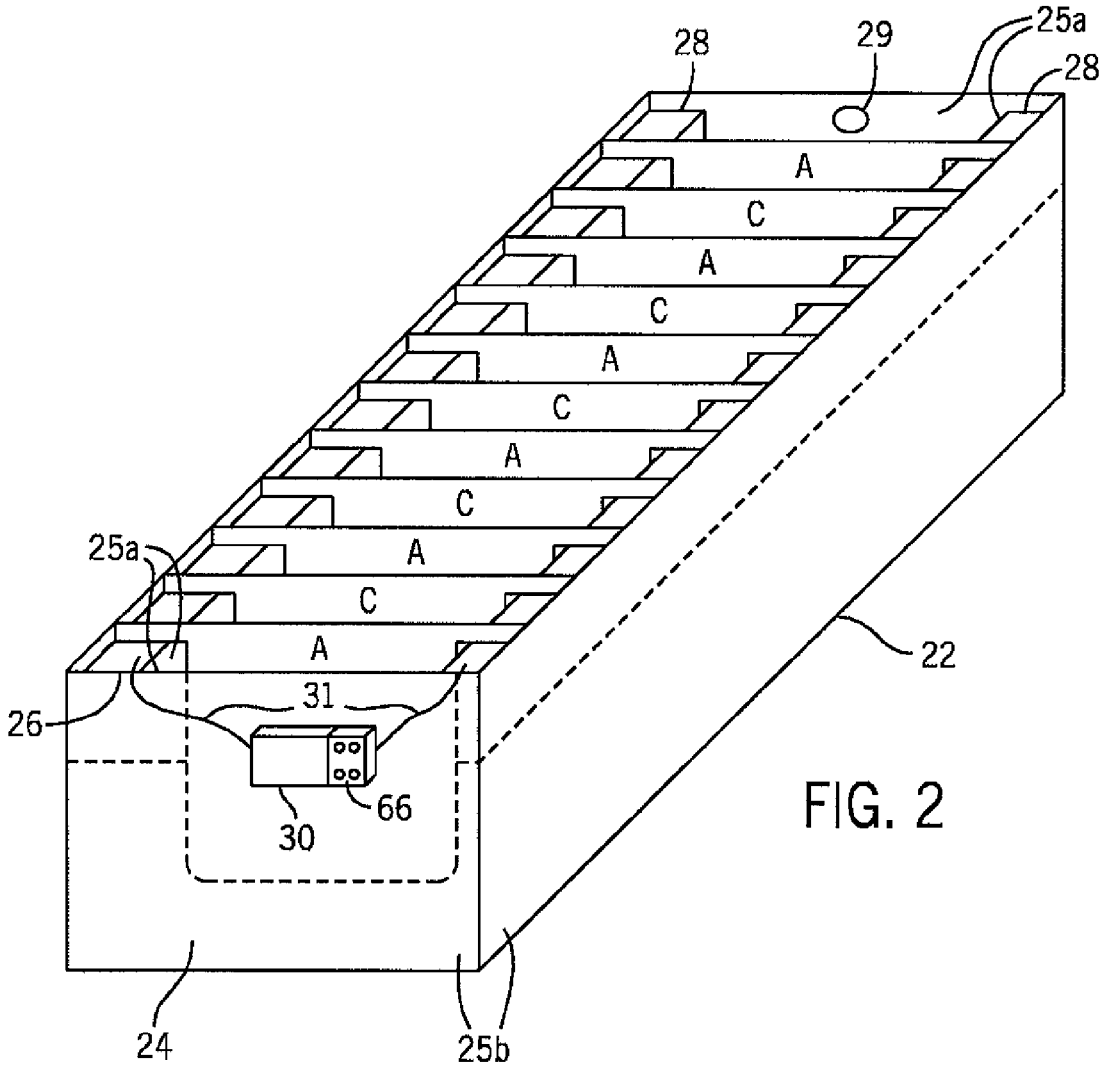
FIG. 2 is a perspective view of an electrolytic cell monitor (ECM) affixed to a representative electrolytic cell.

Referring now to FIG. 2, electrolytic cell 22 is shown, in which anode plates A (i.e., "anodes") and cathode sheets C (i.e., "cathodes") are alternately arranged close to one another and immersed in aqueous electrolyte 24 contained within internal walls 25*a* of the electrolytic cell 22. During copper production, aqueous electrolyte 24 is normally filled relatively close to top surface 26 of electrolytic cell 22, although a lesser amount is shown in the figure for clarity. Within electrolytic cell 22, anodes A and cathodes C are in ear-contact with current rails 28 running lengthwise on top surface 26 of electrolytic cell 22. Current rails 28 carry electrical current to electrolytic cell 22 to assist in copper ion migration from anodes A to the cathodes C. Although electrolytic cell 22 is generally at an ultra-low voltage (i.e., 0.1-0.8 volts), 25,000 amperes of current is not uncommon about electrolytic cell 22. This cell voltage is typically powered by a bus voltage, which is the voltage impressed across anodes A and cathodes C for the ion migration.

A common copper-producing tank house contains as many as forty (40) sections, each of which contains thirty-six (36) electrolytic cells 22. Moreover, a typical electrolytic cell contains as many as forty-six (46) anode-cathode A-C pairs and can often yield as many as 1440 cells in a common tank house, or in excess of 66,240 anode-cathode A-C pairs. Since short circuits can occur between any of anode-cathode A-C pairs at any time, constant electrolytic cell monitoring is greatly beneficial to increasing copper production. However, the need to provide electrical power to an electrolytic cell monitor at each and every electrolytic cell quickly becomes burdensome. As a result, since hard-wired monitoring system are difficult and expensive to install and maintain, it is estimated that less than 60% of the world's refineries currently monitor cell production, despite the advantages that can be obtained by doing so, as previously elaborated upon.

Accordingly, cell-powered microprocessor-based ECM 30 is electrically attached to electrolytic cell 22, with electrical connections 31 connecting ECM 30 to current rails 28 of electrolytic cell 22. Preferably, a suitable mechanical connection also connects ECM 30 to electrolytic cell 22. For example, in one preferred embodiment, ECM 30 is suspended from a wire form (not shown) depending from top surface 26 along suitable external wall 25*b* of electrolytic cell 22. In another preferred embodiment, electrolytic cell 22 is cast with an indentation suited to receive ECM 30. In yet another preferred embodiment, one or multiple ECMs 30 straddle adjacent cells 22 that are aligned in close physical proximity to one another. Moreover, if ECM 30 is in close physical contact with electrolytic cell 22, it is preferably encased in a suitable housing to protect it from the harsh environment to which it is exposed. In any event, techniques and methods of electromechanical attachment are known in the art and not specifically intended as integral components of the general inventive arrangements. Rather, suitable locations and attachment methods are chosen, preferably to maximize wireless (e.g., radio) link strengths and minimize interference with other copper production steps, such as clearing short circuits as operators walk along top surface 26 of electrolytic cell 22.

In addition, ECM 30 is also attached to, and in electrical communication with, various sensors (not shown) that monitor cell parameters corresponding to physical properties of the electrolytic cell 22 to which the sensors are attached. For example, representative cell parameters include cell voltage, cell temperature, and cell turbidity. Accordingly, suitable voltage sensors (e.g., an analog to digital (A/D) converter) monitor cell voltage. Suitable temperature sensors (e.g., thermometers, thermisters, and the like) monitor cell temperature. And suitable turbidity sensors monitor cell turbidity, often using laser technology. Suitable sensors also provide in-situ monitoring of reagents, specific ion electrode monitoring, and monitoring of the composition of the aqueous electrolyte 24. All of these sensors are in contact and communication with ECM 30.

Regarding the voltage sensor, in one embodiment it comes with the microprocessor on the electrolytic cell monitor board. The microprocessor handles communication, booster control and all other functions of the monitor. The A/D terminal of the microprocessor is connected to the cell bus of the refining cell to take measurements of the cell voltage.

If one preferred embodiment, multiple cell temperatures are monitored, for example, by providing multiple temperature sensors in the electrolytic cell 22, such as placing one near a drain 29 of the electrolytic cell 22 and another along the one or more internal walls 25*a* thereof. Accordingly, accurate heat loss or balance from the electrolytic cell 22 can be monitored. For example, a preferred temperature sensor is the DS18B20 1-Wire® high-precision digital thermometer available from Maxim Integrated Products, Inc. This temperature sensor has a ±0.5° Celsius accuracy over a −10 to +85° Celsius range, reads over a 1-Wire® serial bus in 2's complement format with 12 bits of resolution (i.e., 0.0625° Celsius), does not require field calibration, is parasite powered by its signal line, has a unique, static 64-bit silicon serial number that serves as the bus address for the sensor, and permits multiple DS18B20 sensors to co-exist on the same 1-Wire® bus. Other suitable temperature sensors may also be used.

The one or more cell parameters correspond to one or more physical properties of the electrolytic cell 22 to which the sensors are attached, and the one or more sensors can be integrated components of ECM 30, or, alternatively, added thereto at a subsequent time as component add-on pieces. The preferred ECM 30 is thus flexible with regard to the sensors with which it can operate.

Figure 3:
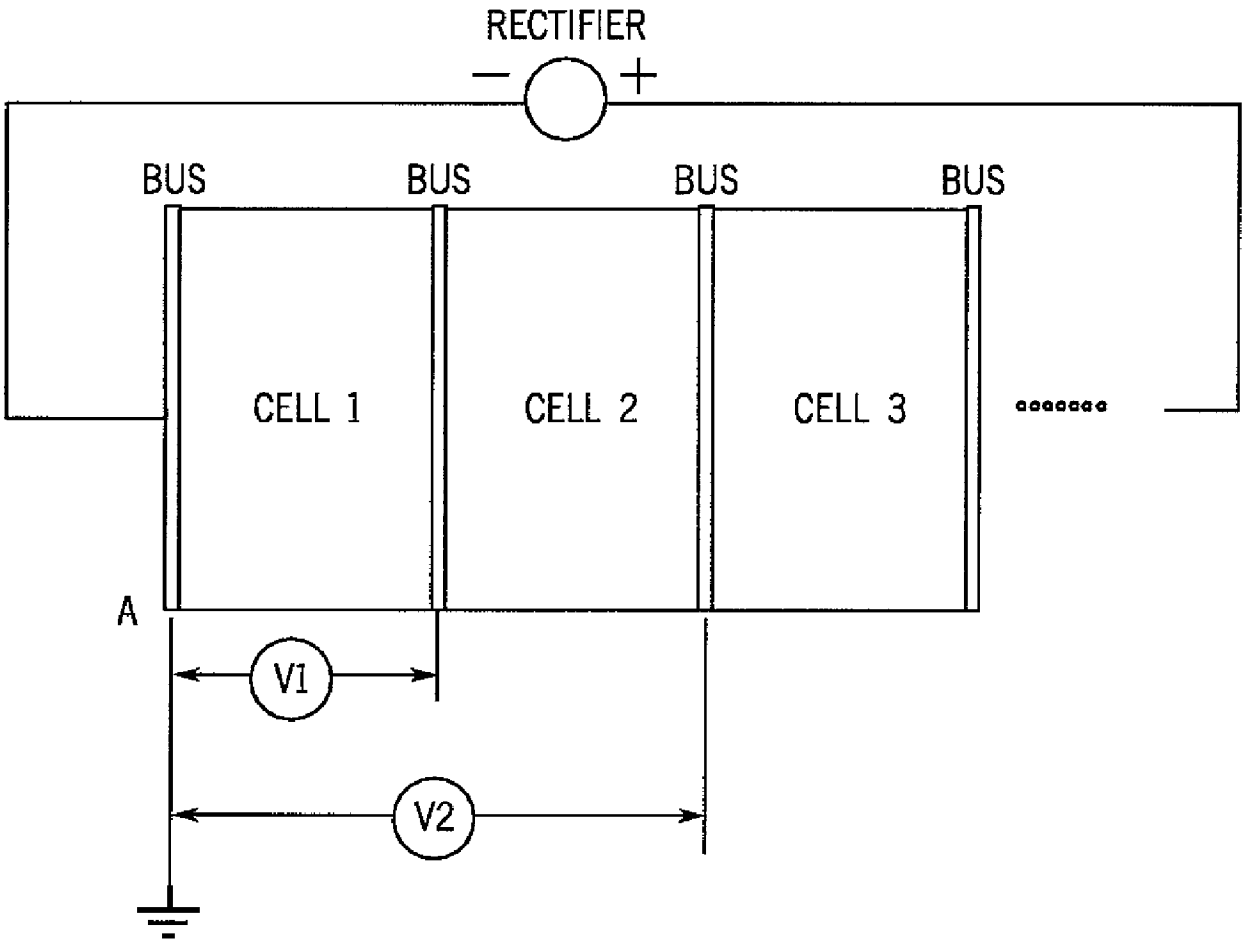
FIG. 3 is a schematic diagram of a monitoring system in which an ECM is monitoring the voltage across two electrolytic cells.
Figure 4:
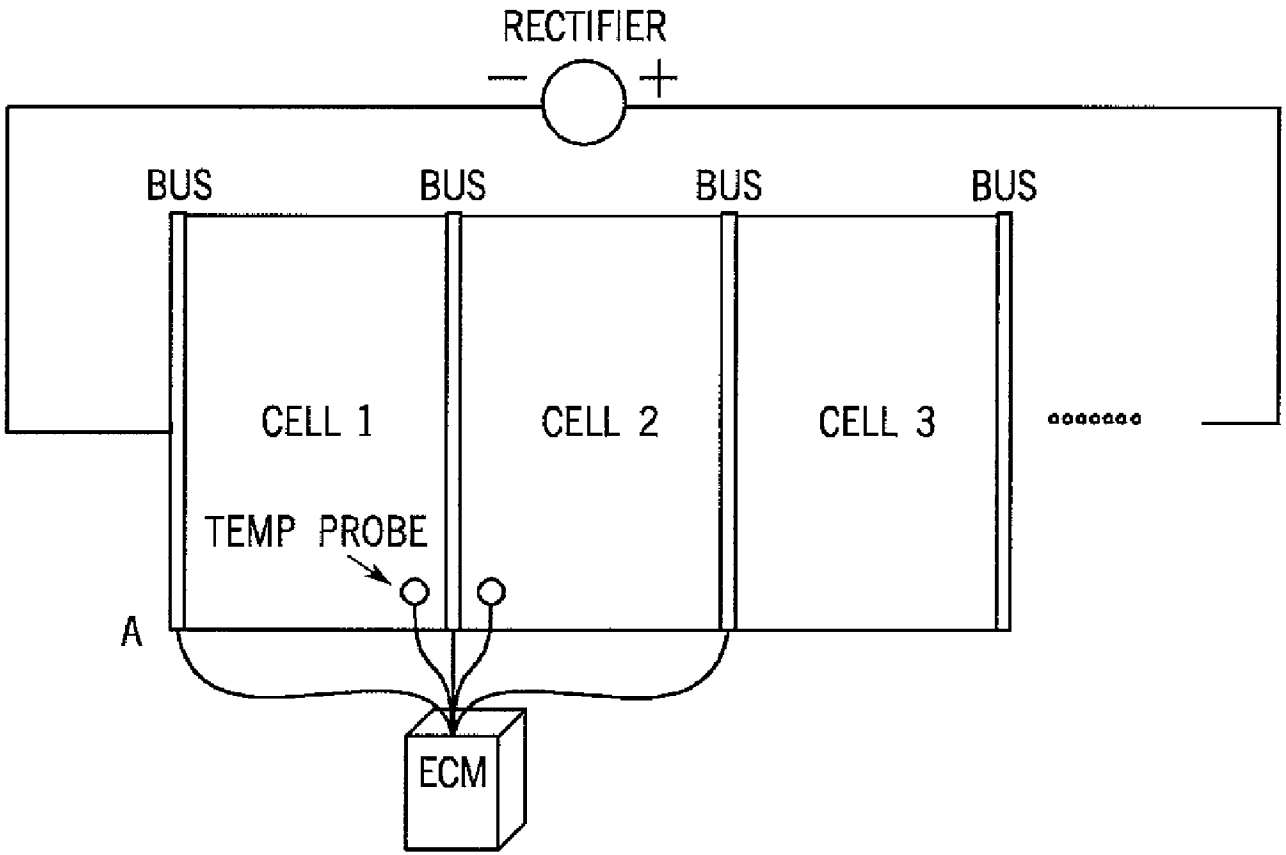
FIG. 4 is a schematic diagram of a monitoring system in which an ECM is monitoring both the voltage across and the temperature of two electrolytic cells.

In one particular embodiment and referring now to FIGS. 3 and 4, one ECM is used to monitor the cell voltage and temperature of two or more cells. In the schematic of FIG. 3, the ECM (not shown) has a common ground at point A. V1 is the cell voltage of cell 1, and V2 is the cell voltage of cell 1 plus cell 2. The cell voltage of cell 2 is simply the difference of V2 minus V1. The voltage booster (not shown) can use the voltage across two or more cells (the number of cells determined by the number of cells connected to ECM). In FIG. 3, the voltage feeding the booster is doubled because the ECM is connected to two cells.

The ECM can be mounted anywhere relative to the cells that it is monitoring, but typically it is mounted between, preferably in the middle of, the two or more cells that it is monitoring. For monitoring two cells, only three wires are necessary as is shown in FIG. 4 (one wire to each bus). Although the middle wire can be a thin wire because it does not draw a large current (it does not draw from the voltage booster), typically it is the same size as the other wires. If other parameters are to be measured (e.g., temperature), then these are easily connected to the ECM by wire particularly given, in most cases, the close proximity of the ECM to the cells.

If one cell is out for whatever reason, e.g., repair of a short, the other cell is not affected because the booster works well from the voltage across the remaining cell. Of course, the concept as described above of using a single ECM to monitor two cells is readily extendible to a single ECM monitoring three or more cells although at some point the additional wiring can diminish the benefits derived from a wireless system.

The arrangement of this embodiment can reduce the number of ECMs (and thus the cost of purchasing and maintaining ECMs) by half (more if one ECM is used to monitor more than two cells).

Figure 5:
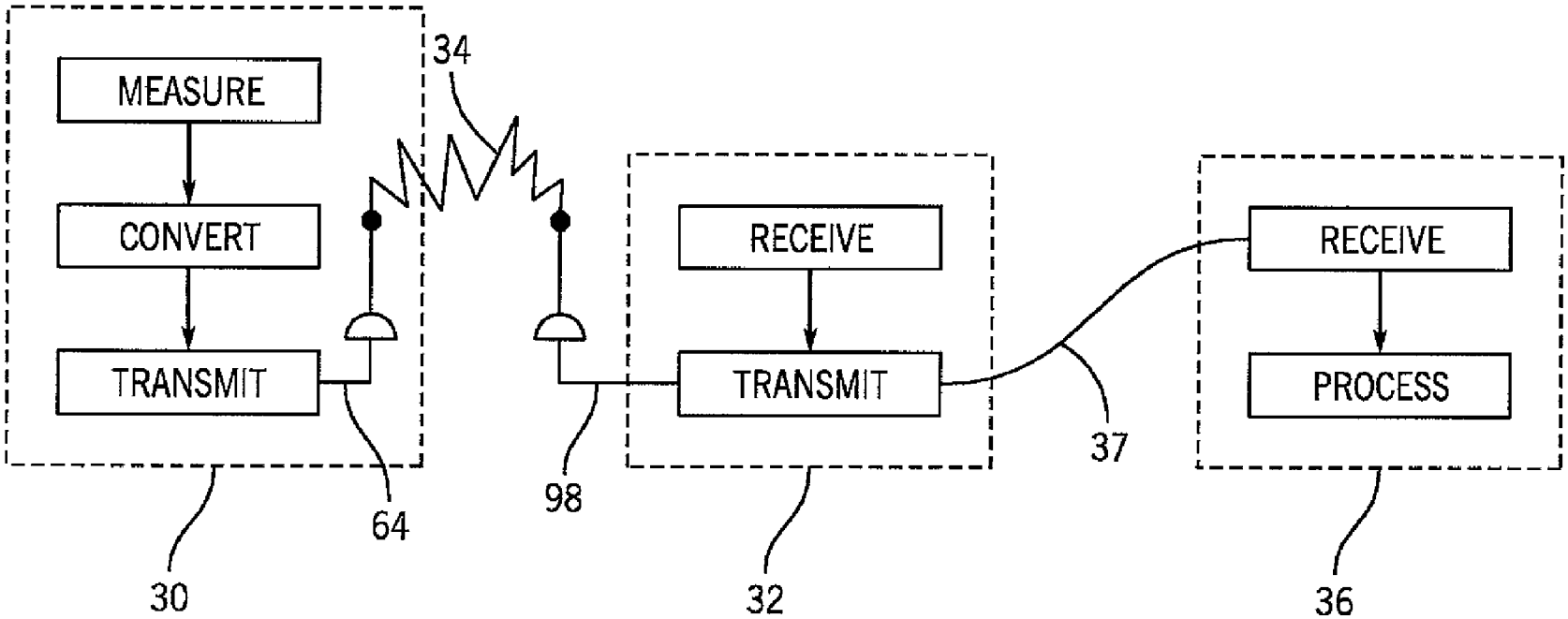
FIG. 5 is a functional diagram of the monitoring system of the present invention, comprising an ECM in communication with a coordinator in communication with a computer.

Referring now to FIG. 5, ECM 30 is preferably in electronic communication with one or more coordinators 32 over a real-time, wireless communications network 34. Preferably, communication between ECMs 30 and coordinators 32 is two-way, with each device comprising transmitting and receiving capabilities. Any suitable wireless communications network 34 can be employed, including both public and private wireless communications networks 34. For example, IEEE 802.15.4 based-network is commonly used for standard, low-rate, wireless personal area networks.

Preferably, coordinators 32 are physically separate and remote from ECMs 30. For example, in a preferred embodiment coordinators 32 are suspended from, or mounted on, a tower, ceiling, or wall in the tank house. In other words, coordinators 32 are preferably located outside of the immediate operating area of electrolytic cells 22 and respective ECMs 30. So, while ECMs 30 are preferably electrically and mechanically attached to electrolytic cells 22, coordinators 32 are physically remote therefrom.

In addition, a computer 36 is in electronic communication with coordinators 32, preferably over a hard-wired, traditional network interface 37, such as connecting coordinators 32 to the computer 36 through a RS-232 port, one of its successor RS-422/RS-485 ports, a USB port, or an Ethernet port, all of which are well-known techniques in the art for connecting serial devices. The computer 36 operates as a typical computer or machine readable medium, and it may be implemented as a desktop, laptop, tablet PC, or other appropriate computing platform. Typically, it comprises a system including a processor, but the specific details are not intended as integral components of the general inventive arrangements.

As depicted, ECMs 30 generally accomplish three primary functions: i) measure one or more cell parameters of electrolytic cells 22; ii) convert cell parameters into one or more data signals (i.e., digital data or digital signals) using traditional analog-to-digital ("A/D") converters or digital ports of the microprocessor; and iii) wirelessly transmit these data signals to the one or more of coordinators 32 over the real-time, wireless communications network 34. They may also implement digital signal processing algorithms and self-diagnose information about themselves. Likewise, coordinators 32 generally accomplish two primary functions, i) receive these data signals from the one or more ECMs 30 over the real-time, wireless communications network 34; and ii) transmit these data signals to the computer 36. And finally, the computer 36 generally accomplishes two primary functions: i) receives data signals from coordinators 32 and reports data to a database or data historian that reside on the computer 36 or another computer (not shown) on the plant computer network (not otherwise shown in FIG. 3); and ii) processes and analyzes data and generates diagnostic information about the communication status of ECMs 30 and coordinators 32. These wireless communication links in the cell monitoring system are not intended to be unilateral, per se, but also encompass bilateral communications in which transmitter and receiver functionality can be integrated within a single device.

In a large-scale tank house, coordinators 32 communicate through one or more routers 40 and gateway 42, as will be elaborated upon. Multiple gateways 42 can also be implemented if the tank house is sufficiently large or otherwise so requires.

In the preferred embodiment depicted, ECMs 30 wirelessly transmit to coordinators 32, which serve as a go-between between ECMs 30 and computer 36, principally to remove computer 36 from the tank house and its hostile environment. In another preferred embodiment, however, ECMs 30 wirelessly transmit directly to computer 36, without transmitting to coordinators 32 as a go-between.

Figure 6:
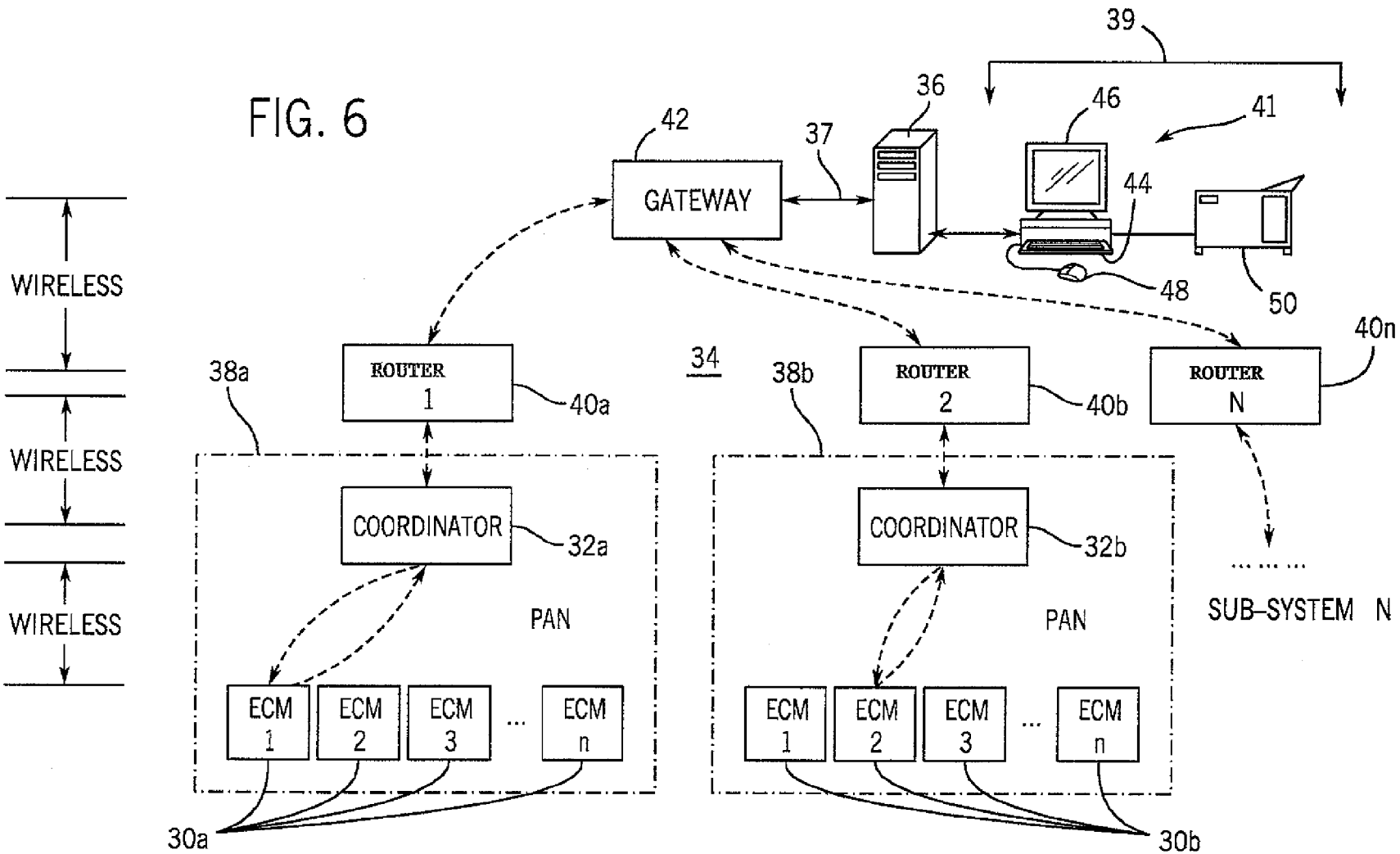
FIG. 6 is an architectural diagram of a representative embodiment of a preferred wireless communications network of the present invention.

Referring now to FIG. 6, a preferred embodiment of the real-time, wireless communications network 34 is shown, in which first coordinator 32*a* serves as many as several hundred or so first ECMs 30*a* as part of first sub-system 38*a*. Likewise, second coordinator 32*b* serves another several hundred or so second ECMs 30*b* as part of second sub-system 38*b*, and likewise for $N^{th}$ coordinator 32*n* and $N^{th}$ sub-system 38*n*. As indicated, each coordinator 32 is preferably physically remote from each respective set of ECMs 30 and in wireless communication with each. In one embodiment, eight (8) coordinators services 1440 electrolytic cells spread out over several hectares of a common copper producing tank house. As needed, however, the inventive arrangements are fully scalable, and more or less coordinators may be provided as necessary. In addition, and as will be described, each coordinator 32 preferably frequency hops, i.e., each coordinator 32 utilizes a frequency hopping system. In other words, these coordinators 32 preferably utilize different frequency hopping sequences, which enable the multiple coordinators 32 to co-exist.

In another embodiment, electronic communication between coordinators 32 and computer 36 is further comprised of electronic communications from coordinators 32 to routers 40, from routers 40 to gateway 42, and then from gateway 42 to computer 36, as shown in FIG. 6. More specifically, first coordinator 32*a* is in electronic communication with first router 40*a*, second coordinator 32*b* is in electronic communication with second router 40*b*, and likewise for $N^{th}$ coordinator 32*n* in electronic communication with $N^{th}$ router 40*n*. Preferably, each of routers 40 is simply another coordinator 32, and it communicates between one or more coordinators 32 and gateway 42. Preferably, gateway 42 is another coordinator 32 as well and communicates between its respective routers 40 and computer 36. Thus, a reciprocating ECM-coordinator-ECM-coordinator arrangement preferably exists for transmitting data from the sensors of electrolytic cell 22 to computer 36 over real-time, wireless communications network 34. In a preferred embodiment, each of ECMs 30, coordinators 32, routers 40, and gateway 42 are formed from the same hardware, thus facilitating this arrangement. Appropriate software can be implemented on each to accomplish this objective.

Although electronic communication between i) ECMs 30 and coordinators 32, ii) coordinators 32 and routers 40, and iii) routers 40 and gateway 42 is wireless, communication between gateway 42 and computer 36 is preferably hardwired over traditional network interface 37, such as connecting gateway 42 to computer 36 through the RS-232 port, one of its successor RS-422/RS-485 ports, a USB port, or an Ethernet port, all of which are well-known techniques in the art for connecting serial devices. In any event, computer 36 eventually processes data signals received from respective ECMs 30.

In a preferred embodiment, computer 36 normally plays a role as a bridge or gateway between the cell monitoring system (i.e., ECMs 30, coordinators 32, router 40, and gateway 42) and existing plant computer network 39. It reports data to the database or data historian that reside on computer 36 or another computer (not shown) on plant computer network 39, which is commonly an Ethernet network., or other plant information system. Because the cell monitoring data is available on plant computer network 39, one or more computer application workstations 41, with appropriate installed cell monitoring application software (e.g., CellSense from the Outokumpu Group in Espoo, Finland), can be utilized. Computer application workstation 41 can access cell monitoring data from the data server and compute tank house cell characteristics, such as tank house performance. The results can be presented to an operator in any suitable fashion on any computer (i.e., desktop, laptop, tablet PC, or other appropriate computing platform) on plant computer network 39. As such, typical computer application workstations 41 may include keyboard 44, monitor 46, and mouse 48 for controlling and interacting with workstation 41, as well as printer 50 to hard-copy information or data from computer 36 or plant computer network 39.

Figure 7:
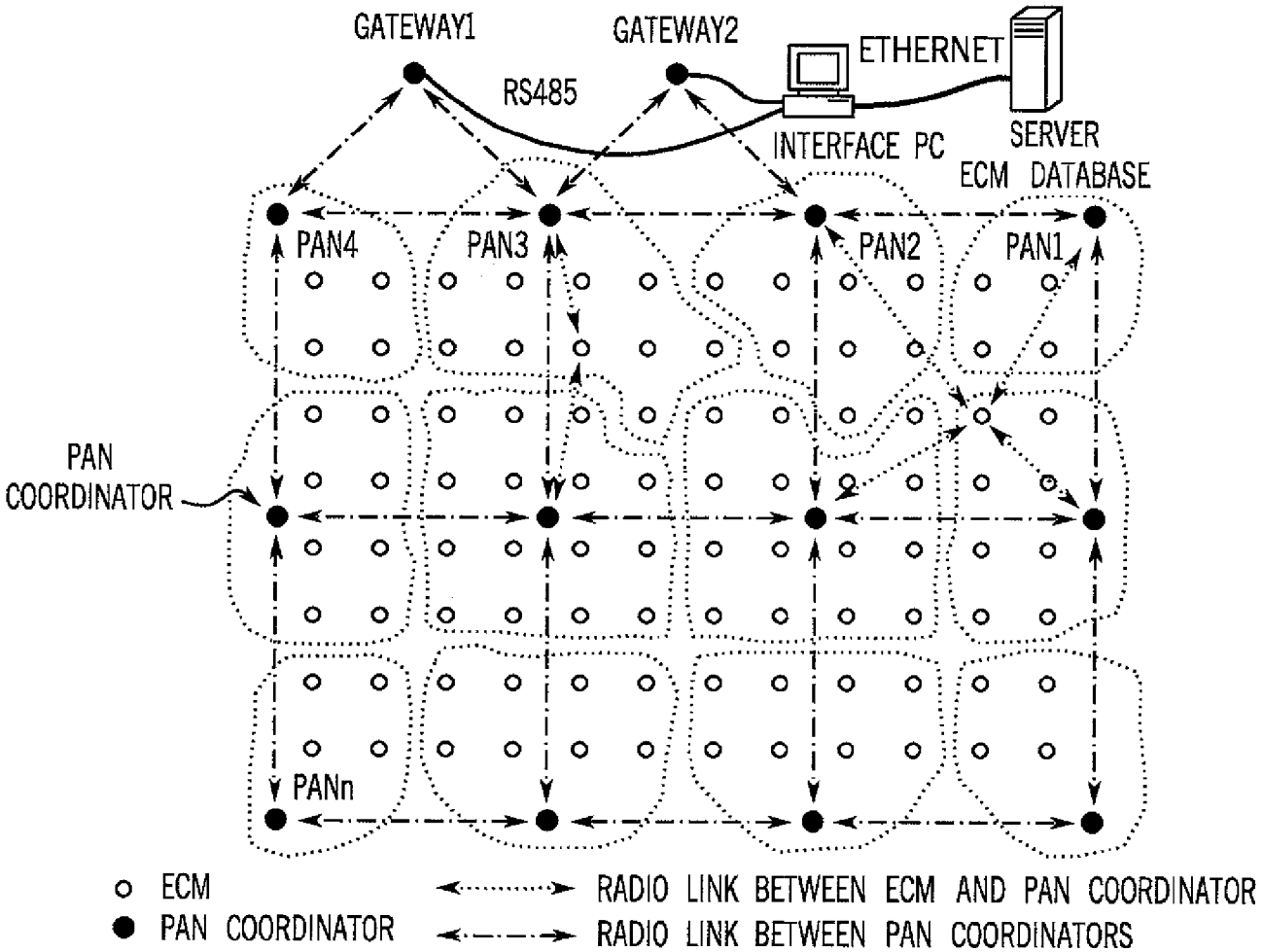
FIG. 7 is a schematic diagram of a self-organizing, self-healing ECM Personal Area Network (PAN).
Figure 8:
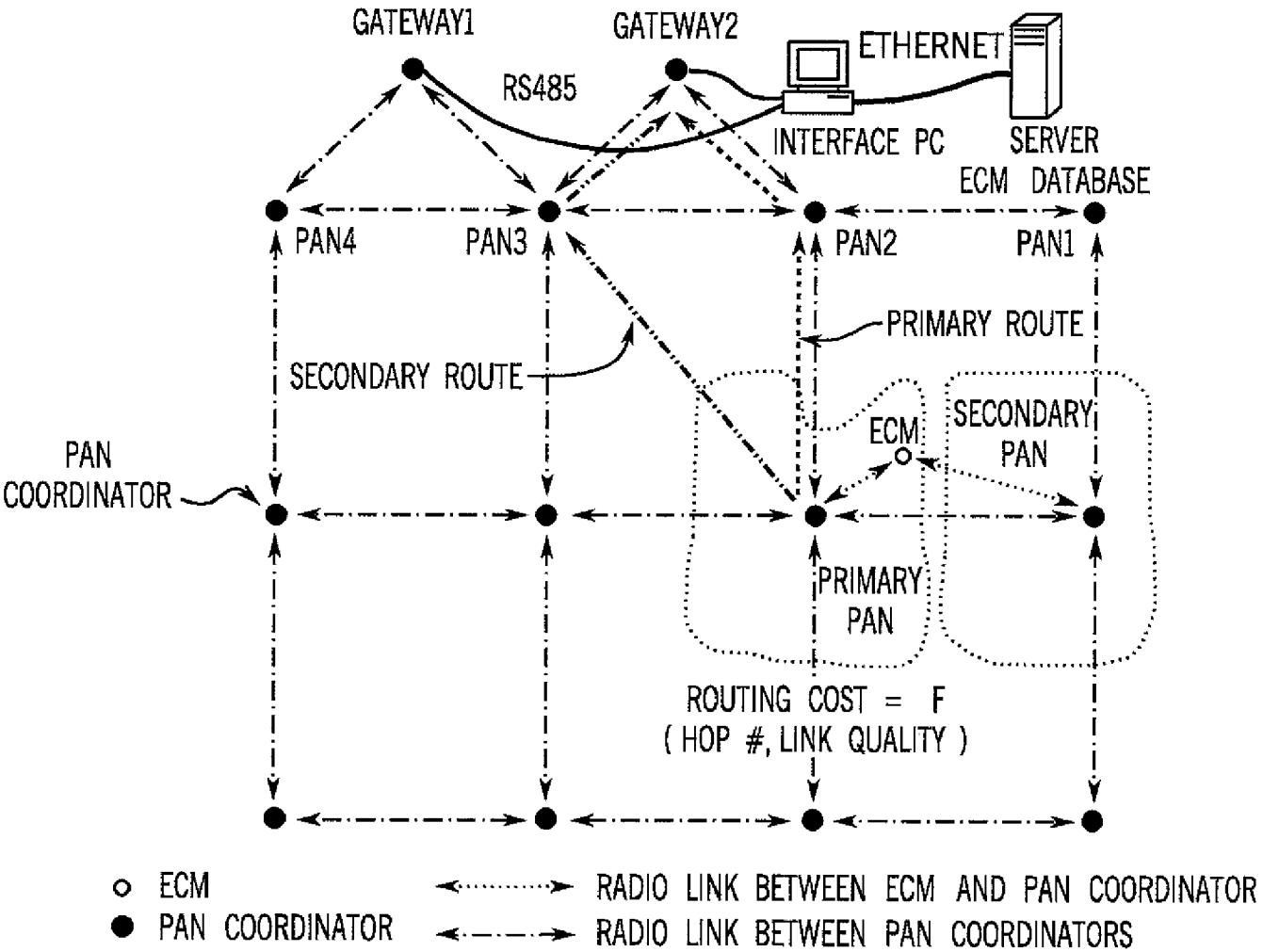
FIG. 8 is a schematic diagram explaining redundant, multi-path wireless network.

FIGS. 7 and 8 describe one embodiment of the invention in which the ECMs are arranged in a self-organizing, self-healing personal area network (PAN). In this embodiment, PAN coordinators are located about, typically above, an array of ECMs which in turn are attached to the various electrolytic cells comprising the tank house. On initiation of the PAN, the ECMs actively scan the area to find all of the coordinators within radio-signal proximity, and then sort the coordinators according to radio-signal strength. Each ECM will establish a radio link with the coordinator to which it has the strongest signal, and will save the identity of the coordinator with the second strongest signal as secondary or backup coordinator. The ECMs that establish a primary radio link with a particular coordinator form a PAN with that coordinator. In a similar fashion, the coordinators will connect by wireless electrical communication with a gateway. If the primary PAN fails for whatever reason, the ECMs of the primary PAN will immediately establish radio communication with its secondary coordinator. Not all ECMs in a given primary PAN will establish a new radio link with the same secondary coordinator. Rather, the ECMs will redistribute into a new PAN depending in large part on their distance to their secondary coordinator. If radio communication with the secondary coordinator also fails, then the ECMs in that PAN will initiate another active scan to re-establish a primary and secondary PAN. In this respect, the PAN is both self-organizing and self-healing.

The coordinators also serve as routers in backup situations. Once a coordinator begins to receive signals from ECMs outside of its primary PAN, it will scan the area for other coordinators and route the collected information to the coordinators that will deliver it to the gateway in the most efficient manner. Routing cost is a function of the number of "hops" the information must make to other coordinators before reaching a gateway and the link quality, e.g., the strength of the radio signal. This is illustrated in FIG. 8.

Various public communication protocols are available with which to operate the PANs, such as ZigBee. ZigBee is a suite of high level communication protocols using small, low-power digital radios based on the IEEE 802.15.4 standard for wireless personal area networks. ZigBee operates in the industrial, scientific and medical radio bands; 868 MHz in Europe, 915 MHz in the United States and 2.4 GHz in most of the jurisdictions worldwide.

Those skilled in the art will recognize that the inventive arrangements can be realized in hardware, software, firmware, or any various combinations of these elements. A representative visualization tool according to the inventive arrangements can be realized in a centralized fashion over one computer 36, or, alternatively, in a distributed fashion in which multiple elements and components are spread over multiple, interconnected computers 36. Moreover, any kind of computer 36, or other apparatus, adapted for carrying out the arrangements of this invention can be used. One typical combination of hardware and software, for example, includes general purpose computer 36 with a computer program that, upon loading and execution, controls computer 36 such that the described inventive arrangements are realized.

Thus, in a preferred embodiment, computer 36 is an interface to an existing plant information system computer, which can function as a data historian for the tank house and its operators.

Figure 9:
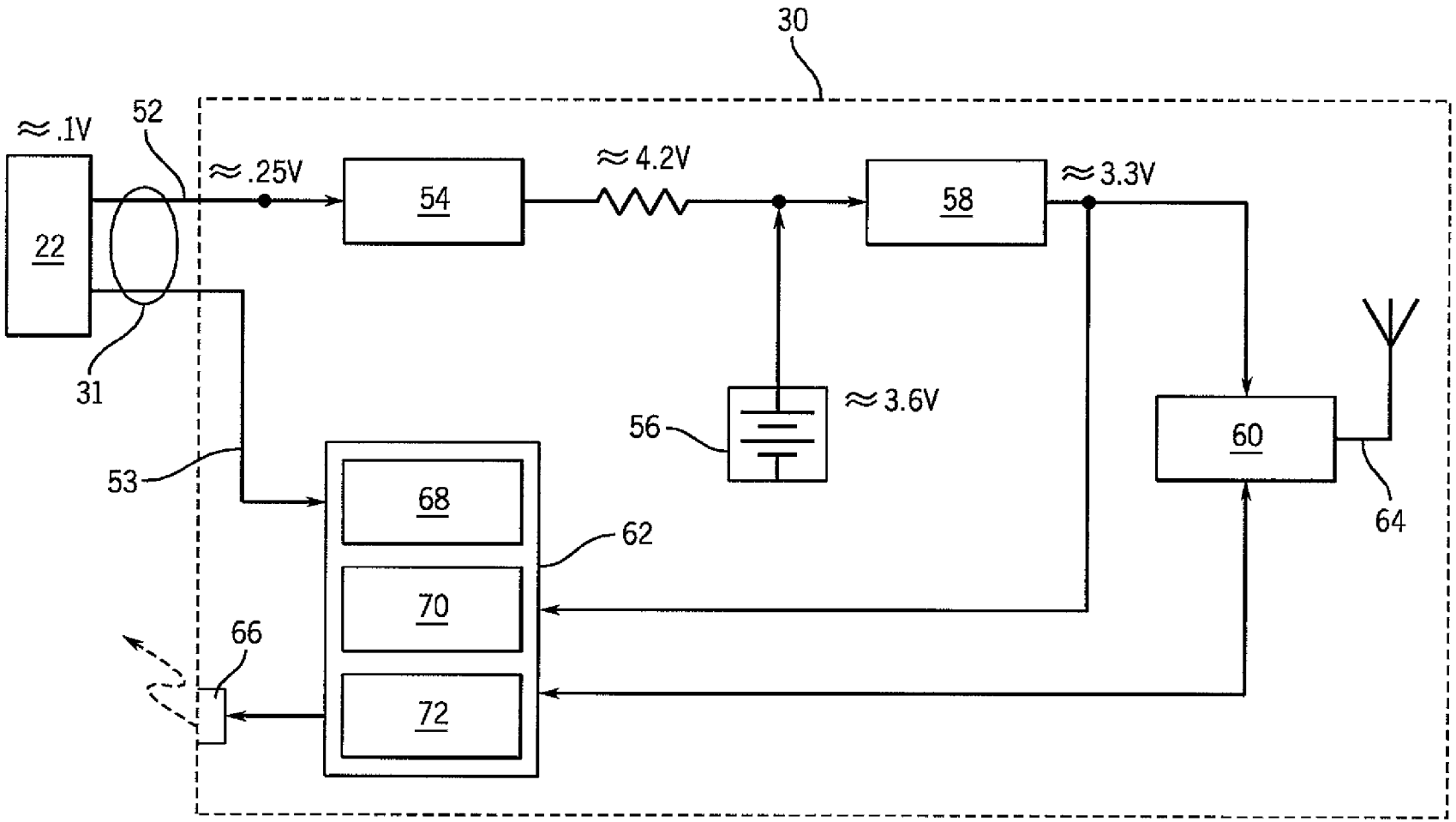
FIG. 9 is functional block diagram of an ECM.

Referring now to FIG. 9, a functional block diagram of ECM 30 is shown. More specifically, at least two electrical connections 31 are provided between electrolytic cell 22 and ECM 30. First connection 52 utilizes the bus voltage, which is the voltage impressed across the anodes A and cathodes C, to power ECM 30. The cell voltage is also measured through this connection. Second connection 53 communicates with the various sensors that monitor the cell parameters that correspond to the physical properties of electrolytic cell 22 to which the sensors are attached.

Typical cell voltages generally range between approximately 0.1-0.8 volts, and they are commonly between approximately 0.2-0.3 volts, and even more commonly, they are approximately 0.25 volts. This is generally insufficient to power the microprocessor-based ECM 30, so voltage booster 54 is provided. Voltage booster 54 boosts the ultra-low cell voltages from the approximately less then 0.1 to approximately 5.0 volts. If insufficient voltage is available from electrolytic cell 22 to power voltage booster 54 (i.e., voltage greater than 0.15 volts may not always be available from electrolytic cell 22), re-chargeable battery 56 can also be provided as an energy reservoir, preferably at approximately 3.6 volts. Representative rechargeable batteries 56 include a NiCad battery, a NIMH battery, a lithium-ion battery, or the like. Preferably, rechargeable battery 56 is suitable for low current charge and high ambient working temperature. On the other hand, if sufficient voltage is available from electrolytic cell 22 to power microprocessor-based ECM 30, it can be used directly, without voltage booster 54 or rechargeable battery 56. In other words, if sufficient voltage is available from electrolytic cell 22 to feed voltage booster 54 (i.e., greater than 0.15 volts), then ECM 30 can be powered by voltage booster 54. Voltage booster 54 will also charge rechargeable battery 56 when the cell voltage is high enough (i.e., greater then 0.15 volts).

Rechargeable battery 56 can be recharged in different fashions, including, for example: i) recharging battery 56 whenever sufficient voltage is available from electrolytic cell 22; or ii) recharging battery 56 only when the battery voltage falls below a certain threshold level. In order to reduce interference, voltage booster 54 is shutdown and ECM 30 is powered with rechargeable battery 56 while sampling the cell parameters and transmitting or receiving data through the wireless data transfer mechanisms of this invention.

In any event, through either the voltage from voltage booster 54 or the voltage from rechargeable battery 56, voltage regulator 58 provides a constant supply voltage of approximately 3.3 volts to ECM's 30 transceiver 60 and microprocessor 62.

Transceiver 60 preferably communicates with coordinators 32 through antenna 64 using a Frequency Hopping Spread Spectrum ("FHSS") or Direct Sequence Spread Spectrum ("DSSS") over the Industrial, Scientific, and Medical ("ISM") Band. Preferably, antenna 64 is internal to ECM 30 due to the hostile environment to which ECM 30 is exposed, but external antenna 64 can also be provided if needed or desired.

In any event, the supply voltage from voltage regulator 58 also powers microprocessor 62, which contains A/D converter 68 for converting analog signals from electrolytic cell 22 to which the sensors are attached. Microprocessor 62 also contains protocol software 70 for controlling ECM 30 and Proportional, Integrated, Derivative ("PID") controller or other algorithm 72 for voltage booster 54.

Accordingly, ECM 30 generally performs at least one or more of the following functions: samples and converts electrolytic cell parameters to digital data; processes digital data using certain digital signal processing algorithms, such as digital filtering; transmits the digital data signals to coordinators 32 through a wireless communications network 34 such as a wireless radio link; provides power to itself by boosting the ultra-low cell voltage, and uses a rechargeable battery 56 for back-up power. In a preferred embodiment, it has the following specifications: uses the FHSS or DSSS over the ISM radio frequency band; utilizes a baud rate of about 75-250 k bits/second or greater; has a transmitting and receiving range of approximately 200 feet or greater; three or more 10 bit A/D channels; an operating ambient temperature of approximately −10 to +85° Celsius or greater; a digital temperature sensor resolution of ±0.0615° C. or greater; and utilizes an LED output 66 to communicate cell data, such as cell voltage. Because it is microprocessor-based, ECM 30 can also be programmed to compress and filter the data signals prior to transmission to coordinators 32, process data onboard and recognize deviations from pre-determined set-point thresholds, analyze the electrical connection quality between itself and electrolytic cell 22, and implement the wireless protocol by which it communicates to coordinators 32.

Figure 10:
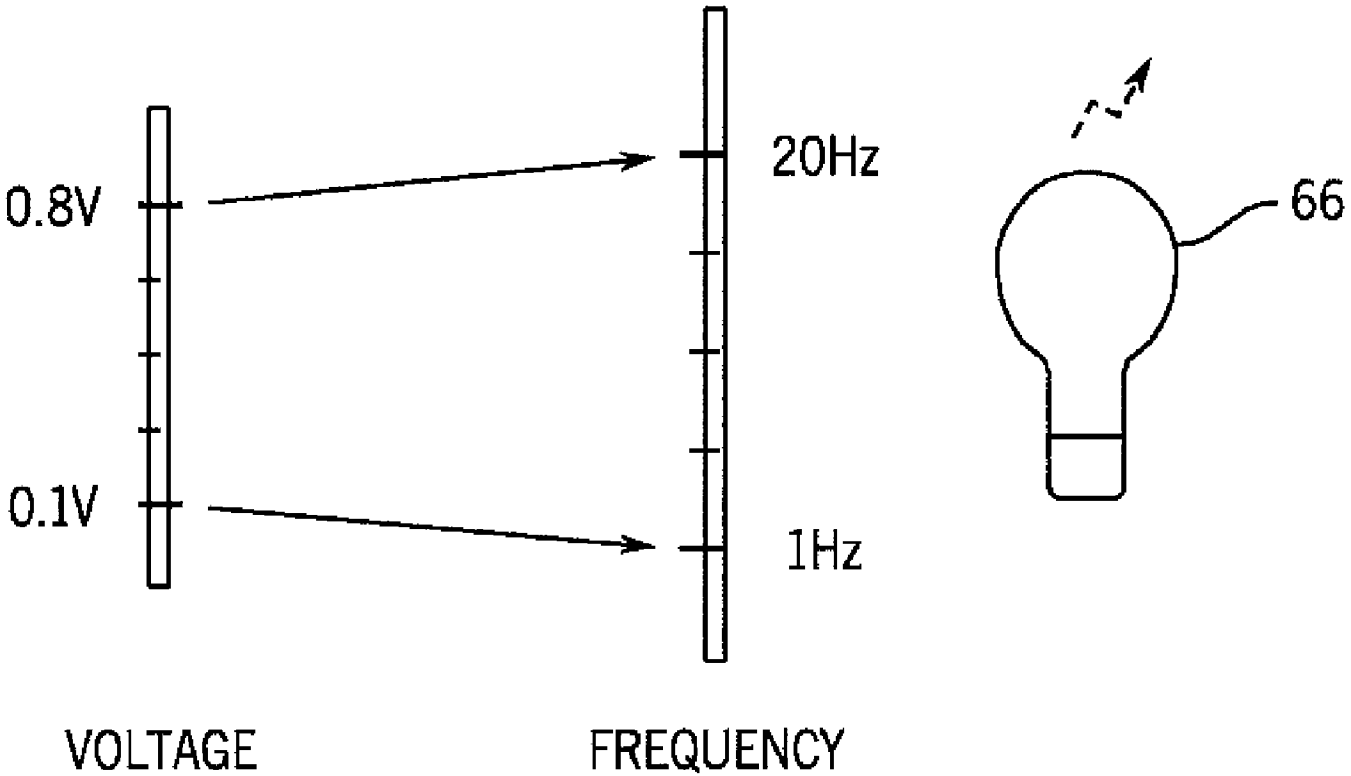
FIG. 10 is a visual representation of a preferred voltage to frequency mapping.

FIG. 10 depicts one preferred way for LED output 66 of ECM 30 to communicate electrolytic cell 22 data. More specifically, cell voltage, which is an important cell parameter, is visually indicated to operators viewing ECM 30. For example, the cell voltage can be linearly converted to a LED flashing frequency so that a short circuit in electrolytic cell 22 can be easily identified in the tank house by an operator visually comparing the flashing frequency of various LED outputs 66. In another preferred embodiment, multiple (i.e., four) LED outputs 66 can be utilized, with different colors representing different conditions of ECMs. These LED outputs 66 can be utilized for diagnostic purposes such as transmission monitoring and short circuit identification. In another preferred embodiment, audible outputs are also provided to communicate cell data. These types of indicators permit operators to focus efforts away from a large population of electrolytic cells 22 and focus on such electrolytic cells 22 that need more immediate attention.

Figure 11:
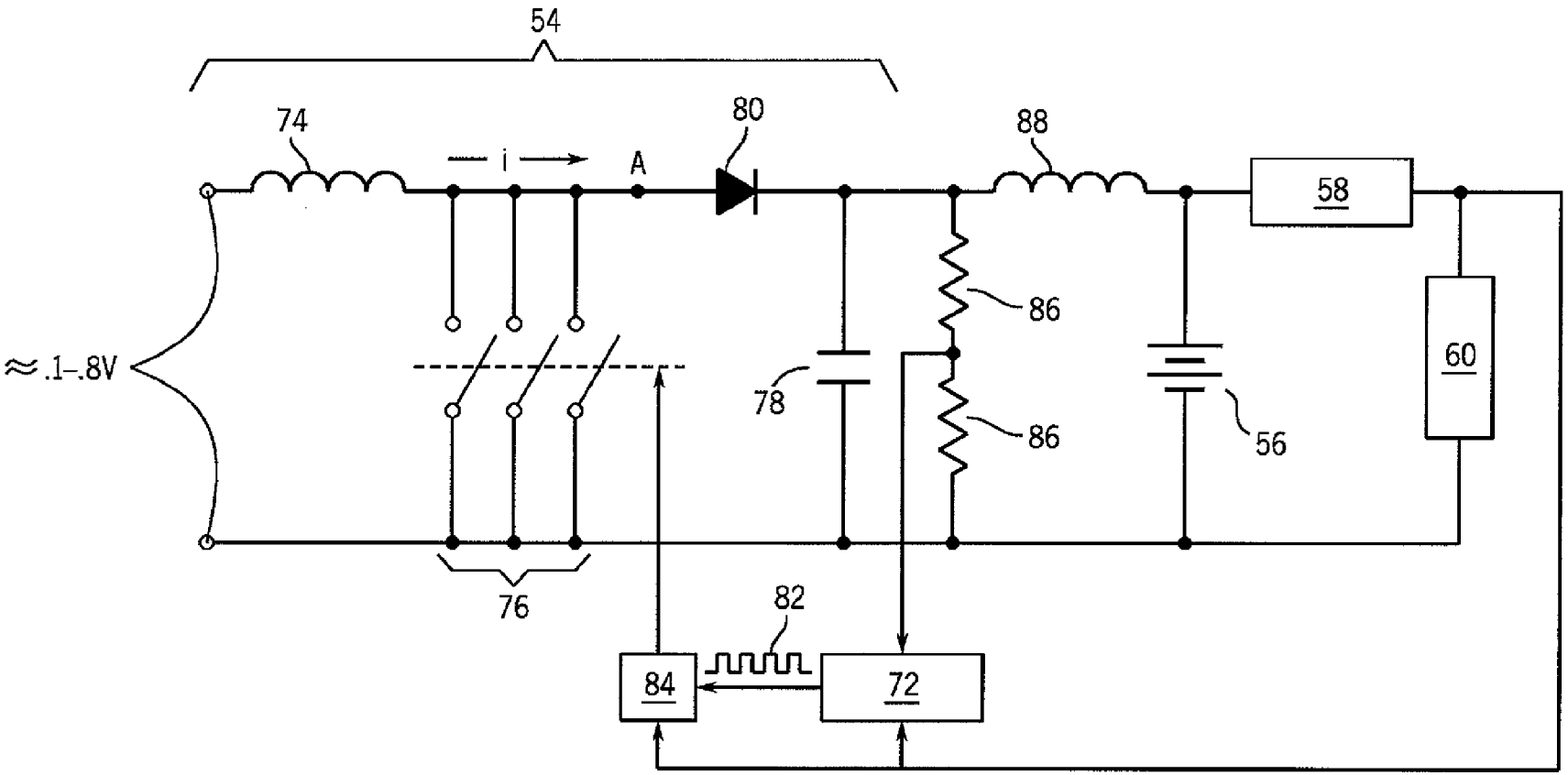
FIG. 11 is a preferred voltage boosting circuit.

Referring now to FIG. 11, voltage booster 54 of FIG. 9 is provided to boost the ultra-low cell voltages from the approximately less than 0.1 volts to a sufficient voltage to power ECM 30 and recharge rechargeable battery 56. More specifically, first inductor 74 converts electrical energy into magnetic field energy when switching array 76—which contains minimal resistance and low gate capacitance, and, preferably, one or more suitable MOSFET devices—is closed. When switching array 76 is opened, the magnetic field energy stored in first inductor 74 generates a high voltage at node A in order to keep the current i constant. This high voltage charges capacitor 78 through diode 80. The amount of charge capacitor 78 receives depends, in part, on the ON-OFF duty cycle of switching array 76, which is controlled by PID controller or other algorithm 72 of microprocessor 62. Accordingly, the booster output voltage is regulated by altering pulse width modulation ("PWM") duty cycle 82, which is controlled by PID controller or other algorithm 72 of microprocessor 62 operating through low-power consuming driver 84 known to those skilled in the art. In addition, PWM frequency is preferably higher than 50 k Hz.

Through 3.3 volts voltage regulator 58, rechargeable battery 56 is used both as an initial energy source for ECM 30 as well as a reservoir. Thus, rechargeable battery 56 powers ECM 30 when ECM 30 is initially turned on, as well as when the ultra-low cell voltage is unavailable or insufficient to power ECM 30. However, whenever the ultra-low cell voltage is available and sufficient to feed voltage booster 54, voltage booster 54 can be turned on and it will power ECM 30 and charges rechargeable batter 56. In a preferred embodiment, a battery voltage can be sampled periodically and the data communicated as diagnostic information to indicate the useful life of rechargeable battery 56.

In order to draw sufficient power from this ultra-low cell voltage, the current i must be high. Thus, voltage booster 54 preferably operates with minimal resistance, and first inductor 74 and switching array 76 are suitably chosen with low resistances, Preferably, for example, the total resistance of first inductor 74 and switching array 76 should be less than 20 m ohms.

As explained, digital PID device 72, preferably built into microprocessor 62, regulates the output of voltage booster 54. Because second inductor 88 has a preferred DC resistance of approximately 2.3 ohms, microprocessor 62 can control the charging current by controlling the voltage drop across inductor 88. The voltage across inductor 88 is the difference of the output voltage of voltage booster 54 and the voltage of battery 56. Preferably, both voltages are sampled by an A/D channel of microprocessor 72 through voltage divider 86. The voltage sampled is the output voltage of voltage booster 54 when voltage booster 54 is turned on, and it will be voltage of battery 56 when voltage booster 54 is turned off. The booster output voltage can be altered by altering set-point of the PID controller or other algorithm 72. In alternative embodiments, different charge strategies can be applied for different types of rechargeable batteries 56.

Preferably, second inductor 88 can be a low pass filter inductor, which can advantageously remove high frequency contaminants of voltage booster 54.

Figure 12:
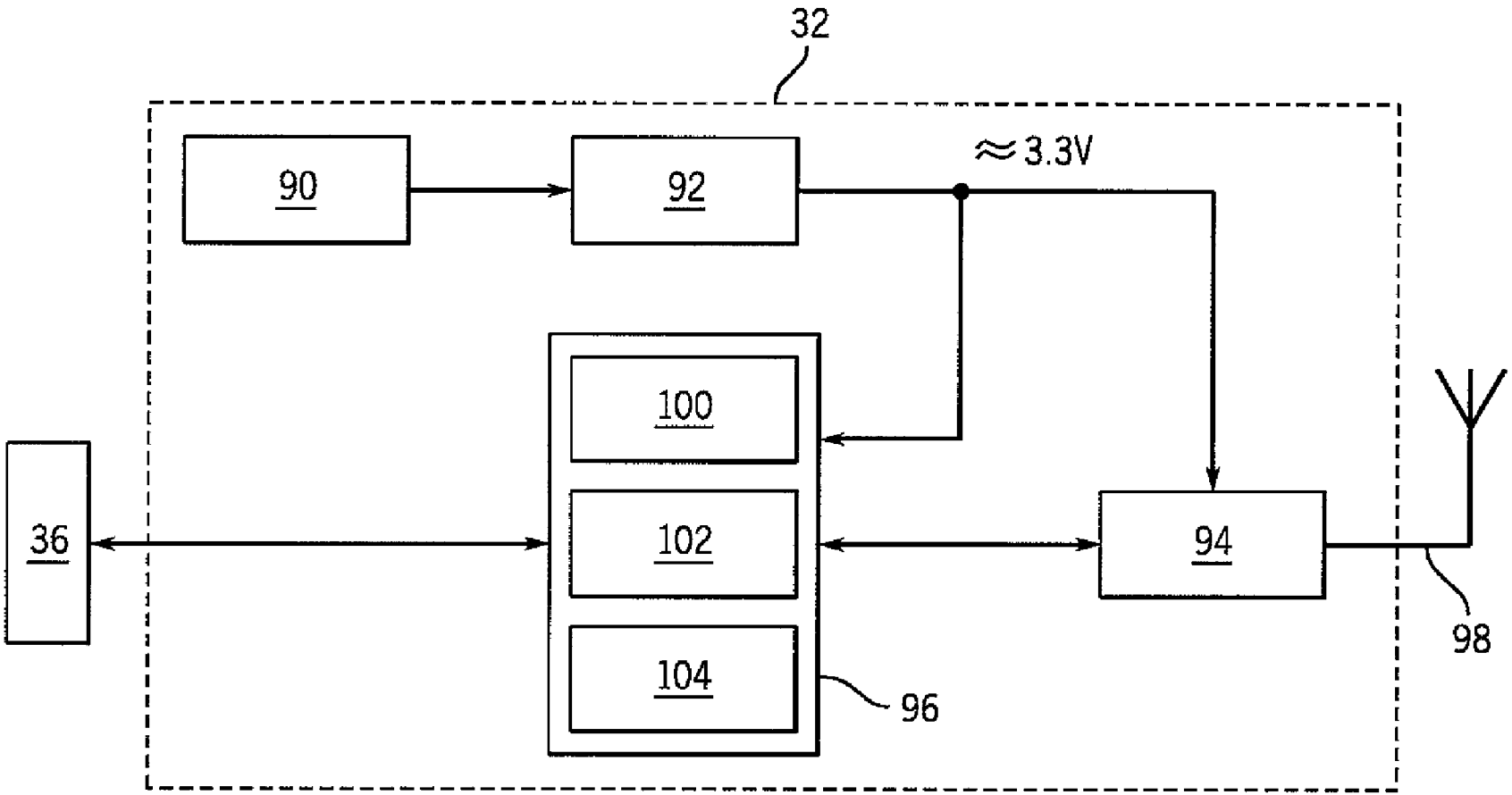
FIG. 12 is functional block diagram of a coordinator.

Referring now to FIG. 12, a functional block diagram of coordinator 32 is shown. As previously mentioned, ECMs 30 and coordinators 32 are preferably formed from the same hardware, with different functionality enabled depending on the application. In any event, coordinator 32 receives a regulated/unregulated 5-9 volts DC from conventional 110 volt AC power adaptor 90 and feeds to voltage regulator 92 to provide a constant supply voltage of 3.3 volts to the coordinator's 32 transceiver 94 and microprocessor 96. Transceiver 94 preferably communicates with ECMs 30 through antenna 98 using the FHSS of DSSS over the ISM Band. Antenna 98 is preferably external to coordinator 32 to increase transmission and reception sensitivities, but internal antenna 98 can also be provided if needed or desired. The microprocessor 96 contains Universal Asynchronous Receiver Transmitter ("UART") 100, which is a standard serial communication port built thereinto. Microprocessor 96 also contains protocol software 102 for controlling coordinator 32 and input/output port 104 for communicating with computer 36.

Accordingly, coordinator 32 generally performs at least one or more of the following functions: receives digital data signals from ECMs 30 through wireless communications network 34 and transmits the data signals to computer 36 either directly or through router 40 and gateway 42, depending on the preferred configuration. In a preferred embodiment, it has the following specifications: uses the FHSS or DSSS over the ISM radio frequency band; has a transmitting and receiving range of approximately 200 feet or greater; an operating temperature of approximately −10 to +85° Celsius or greater; powered by main 110 volts AC, and a maximum power consumption of less than 500 milliWatts (mW).

The Federal Communication Commission ("FCC") permits unlicensed operation in portions of the frequently spectrum called the Industrial, Scientific, and Medical ("ISM") Bands, provided that certain technical restrictions on transmitter power and modulation are met. The most well known ISM band is the 902-928 MHz band in the U.S. (commonly called the 915 MHz band) and the 2.4-2.4835 GHz band worldwide.

SPECIFIC EMBODIMENT

Figure 13:
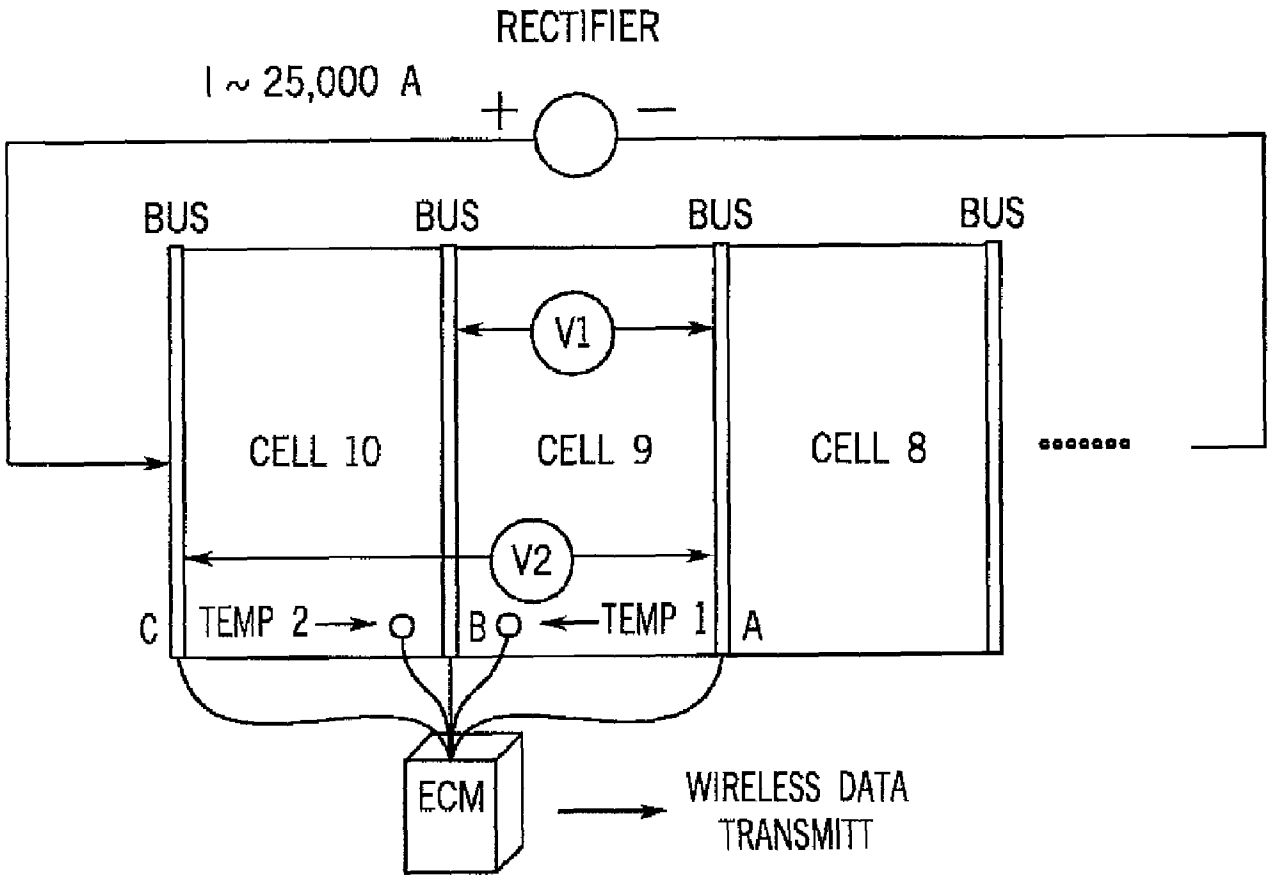
FIG. 13 is a schematic diagram of the monitoring system used in the Specific Embodiment.

To demonstrate the accuracy and consistency of voltage measurement of two electrolytic refining cells located next to one another using one electrolytic cell monitoring (ECM) unit based on one common reference point, voltage readings were taken over about 24 minutes of two adjacent refining cells using both a single ECM unit and a Fluke model 87 III True RMS Multimeter. The test arrangement is shown in FIG. 13.

The test cells were the $8^{th}$, $9^{th}$ and $10^{th}$ cells of a thirty-six cell block connected in series and powered by a direct current (DC) source. The typical current flowing through each cell was about 25,000 amperes and was kept constant. The DC voltage drop on each cell (across the bus on both sides of the wall) was about 0.15V to about 0.35V depending upon the individual cell condition. One ECM unit was used to monitor the voltage drop of the $10^{th}$ and $9^{th}$ cells, and A was the common reference point. The Fluke Multimeter was used to measure the voltage drop of each of these cells individually. The one ECM unit also monitored the temperature of the $10^{th}$ and $9^{th}$ cells.

Figure 14:
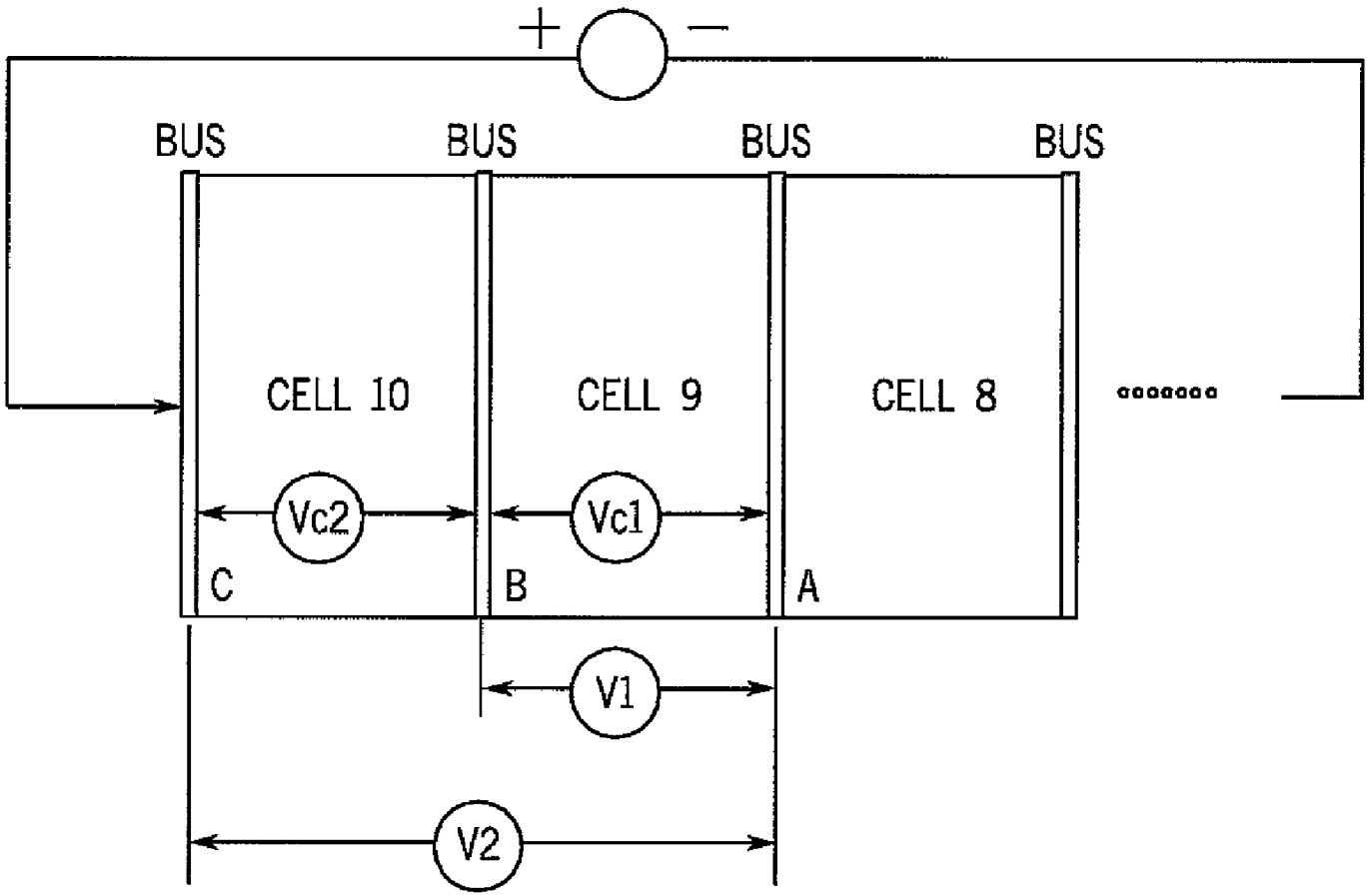
FIG. 14 is a schematic diagram of measured voltages in the Specific Embodiment.

FIG. 14 shows the measured voltages of the $10^{th}$ and $9^{th}$ cells. Vc1 and Vc2 are the bus voltages of the cells. V1 and V2 are the voltages measured directly by the ECM unit using two individual A/D channels of the ECM. Accordingly, Vc1=V1 and Vc2=V2−V1. Vc1 is measured directly, and Vc2 is measured indirectly. To filter our the noise on the bus, the ECM unit samples the voltages at 1024 points with a sampling frequency of 125 KHz, and then averages for a result. The results are reported in the Table below.

TABLE

Test Measurement Data

| | | EMC Measurement | | | | | | Fluke Measurement | | Absolute difference | |
|---|---|---|---|---|---|---|---|---|---|---|---|
| | | | | | | Bus Voltage (V) | | Voltage by Meter | | with Fluke | |
| Create | Date | Temperature | | Voltage (V) | | Vc1 | Vc2 | (V) | | Difference (V) | |
| shorts | Time | T1 | T2 | V1 | V2 | Vc1 = V1 | Vc2 = V2 − V1 | Vm1 | Vm2 | Vm1 − Vc1 | Vm2 − Vc2 |
| | 4:08 pm | 65.250 | 65.313 | 0.338 | 0.660 | 0.338 | 0.322 | 0.339 | 0.321 | 0.001 | −0.001 |
| | 4.15 pm | 65.313 | 65.250 | 0.338 | 0.660 | 0.338 | 0.322 | 0.339 | 0.321 | 0.001 | −0.001 |
| Cell 9 | 4:24 pm | 65.188 | 65.125 | 0.317 | 0.646 | 0.317 | 0.329 | 0.318 | 0.328 | 0.001 | −0.001 |
| | 4:27 pm | 65.125 | 65.250 | 0.313 | 0.642 | 0.313 | 0.329 | 0.314 | 0.329 | 0.001 | 0.000 |
| Cell 10 | 4:32 pm | 65.125 | 65.125 | 0.341 | 0.662 | 0.341 | 0.321 | 0.341 | 0.322 | 0.000 | 0.001 |

V1 is voltage of point B reference to point A and is measured using ECM
V2 is voltage of point C reference to point A and is measured using ECM
Vm1 is volage of poing B reference to point A measured using Fluke
Vm2 is voltage of point C reference to point B measured using Fluke
Vc1 is the cell (bus) voltage of cell #10 from A to B
Vc2 is the cell (bus) voltage of cell #9 from B to C In the Table, Vm1 and Vm2 are voltages of the $10^{th}$ and $9^{th}$ cells measured using the Fluke Multimeter. Vm1 was measured across points A and B, and Vm2 was measured across points B and C. The accuracy of the Fluke Multimeter measurements was verified with a high precision voltage source before the test. At 4:24 p.m. a light short between the anode and cathode was intentionally created in the $9^{th}$ cell. At 4:32 p.m. a light short between the anode and cathode was intentionally created in the $10^{th}$ cell. Comparison of the cell voltages measured by the ECM unit (Vc1 was directly measured and Vc2 was indirectly measured) and the Fluke Multimeter was made. The absolute error for both direct measurement (Vc1 versus Vm1) and indirect measurement (Vc2 versus Vm2) is within ±1 mV. This error is smaller than the resolution of the A/D converter of the ECM unit (2.44 mV, 10-bit with 2.500 V reference) and as such, the error can be ignored. Accordingly, these tests show that the cell voltages measured directly and indirectly by an ECM unit were essentially the same as the cell voltages measured directly by a Fluke Multimeter.

As described above, these technologies can be readily implemented in the inventive arrangements by techniques known in the art. However, the inventive arrangements are not intended to be limited in this regard. For example, while spread spectrum technologies, including FHSS and DSSS, are preferred, narrow band communications can also be used. Likewise, portions of the frequency spectrum other than the ISM band can also be used.

Accordingly, it should be readily apparent that this specification describes exemplary, representative, and non-limiting embodiments of the inventive arrangements. Accordingly, the scope of this invention is not limited to any of these embodiments. Rather, the details and features of these embodiments were disclosed as required. Thus, many changes and modifications—as apparent to those skilled in the art—are within the scope of the invention without departing from the scope hereof, and the inventive arrangements are necessarily inclusive thereof. Accordingly, to apprise the public of the spirit and scope of this invention, the following claims are made:

What is claimed is:

1. An electrolytic cell monitoring system comprising:

a cell-powered first electronic device electrically attached to current rails of the cell, the first electronic device in communication with one or more sensors in at least two electrolytic cells, and a second electronic device in wireless communication with said first electronic device for receiving data signals from said first electronic device, said first electronic device and said second electronic device being physically remote from one another.

2. The system of claim 1 wherein, said first electronic device transmits wild data signals to said second electronic device.

3. The system of claim 1 wherein the wireless communication is an IEEE network.

4. The system of claim 1 wherein the wireless communication is a ZigBee network.

5. The system of claim 1 wherein the wireless communication is a spread spectrum communication network.

6. The system of claim 1 further comprising:

a computer in communication with said second electronic device wherein said second electronic device transmits said data signals to said computer for further processing of said data signals.

7. The system of claim 1 wherein said first electronic device is powered using electrical potential imposed across said cell.

8. The system of claim 7 wherein said first electronic device includes a battery to power said first electronic device when said electrical potential imposed across said cells is insufficient to power said first electronic device.

9. The system of claim 7, wherein said first electronic device boosts said electrical potential imposed across said cells to power said first electronic device.

10. An electrolytic cell monitoring device, comprising:

an electronic component in communication with one or more sensors in two or more electrolytic cells, wherein said component is electrically attached to current rails of the cell and is powered using electrical potential imposed across said cell.

11. The device of claim 10 wherein said device includes a battery to power said device when said electrical potential imposed across said cells is insufficient to power said device.

12. The device of claim 10 wherein said device boosts said electrical potential imposed across said cells to power said device.

13. A method for monitoring two or more electrolytic cells simultaneously, the method comprising:

providing a first electronic device electrically attached to current rails of one of the cells, the first electronic device in communication with one or more sensors in two or more electrolytic cells; and wirelessly transmitting data signals from said first electronic device to a second electronic device, said first electronic device and said second electronic device being physically remote from one another.

14. The method of claim 13 wherein the wirelessly transmitting occurs over an IEEE network.

15. The method of claim 13 wherein the wireless transmitting occurs over a ZigBee network.

16. The method of claim 13 wherein the wirelessly transmitting occurs over a spread spectrum communication network.

17. The method of claim 13 further comprising:

powering said first electronic device using electrical potential imposed across said cell.

18. The method of claim 17 further comprising:

powering said first electronic device using a battery when said electrical potential imposed across said cells is insufficient to power said first electronic device.

19. The method of claim 17 further comprising:

boosting said electrical potential imposed across said cells to power said first electronic device.

20. The electrolytic cell monitoring device of claim 10 comprising:

a first communication coordinating device having a primary wireless link with the electronic component for receiving data signals from the electronic component; and a second communication coordinating device having back-up wireless link with the electronic component for receiving data signals from the electronic component when the primary wireless link fails.

* * * * *

UNITED STATES PATENT AND TRADEMARK OFFICE

CERTIFICATE OF CORRECTION

PATENT NO. : 7,470,356 B2
APPLICATION NO. : 11/422944
DATED : December 30, 2008
INVENTOR(S) : Eugene Yanjun You and Daniel Kang Kim It is certified that error appears in the above-identified patent and that said Letters Patent is hereby corrected as shown below:

Claim 2
Column 15, line 31: Replace “wild” with --said--.

Signed and Sealed this

Twenty-sixth Day of May, 2009

JOHN DOLL
*Acting Director of the United States Patent and Trademark Office*